US010035061B1

(12) United States Patent
Huffman et al.

(10) Patent No.: US 10,035,061 B1
(45) Date of Patent: Jul. 31, 2018

(54) MAGNETIC RECEPTIVE BOARD AND ACCESSORIES FOR TABLETOP GAMING SYSTEM

(71) Applicant: WICKED CONSTRUCT STUDIOS, LLC, Saline, MI (US)

(72) Inventors: Justin C. Huffman, Ann Arbor, MI (US); Jorge S. Livingston, Saline, MI (US); Carl E. Rayl, Ann Arbor, MI (US)

(73) Assignee: Wicked Construct Studios, LLC, Saline, MI (US)

( * ) Notice: Subject to any disclaimer, the term of this patent is extended or adjusted under 35 U.S.C. 154(b) by 0 days.

(21) Appl. No.: 15/489,073

(22) Filed: Apr. 17, 2017

(51) Int. Cl.
*A63F 3/00* (2006.01)

(52) U.S. Cl.
CPC ..... *A63F 3/00694* (2013.01); *A63F 3/00003* (2013.01); *A63F 3/00075* (2013.01); *A63F 2003/0034* (2013.01); *A63F 2003/00359* (2013.01); *A63F 2003/00826* (2013.01)

(58) Field of Classification Search
CPC ..... A63F 3/00694; A63F 2003/00826; A63F 2003/00858
USPC ..... 273/239, 284, 289; 116/325
See application file for complete search history.

(56) References Cited

U.S. PATENT DOCUMENTS 2,572,412 A * 10/1951 Wharton, Jr. ..... A63F 3/00085 273/246
3,210,080 A 10/1965 Rael et al.
3,947,038 A * 3/1976 Archer ..... A63F 3/0434 273/148 A
3,999,504 A * 12/1976 Kearse ..... G09F 7/00 116/200
4,696,476 A 9/1987 Eplett
(Continued)

FOREIGN PATENT DOCUMENTS

GB 2 128 104 A 4/1984
WO 02/066126 A2 8/2002

OTHER PUBLICATIONS

"Magnetic Game Mat" Final Prototype, https://boardgamegeek.com/thread/1206347/magnetic-game-mat-final-prototype Web Mar. 17, 2016.

(Continued)

*Primary Examiner* — Melba Bumgarner
*Assistant Examiner* — Laura L Davison
(74) *Attorney, Agent, or Firm* — John A. Miller; Shumaker, Loop & Kendrick, LLP

(57) ABSTRACT

A system of magnetic and magnetic receptive components used in a tabletop role-playing game. The system includes at least one magnetic receptive terrain board depicting an outdoor terrain or other environment, where the terrain board may be two-sided. The system further includes a variety of flexible single-sided or double-sided magnets depicting characters or natural/man-made features and structures which can be attached to the terrain board, and either left in place or moved during game play. Also included are magnetic-base stands which can hold the character/feature magnets in an adjustable position indicating the item's status, and other magnetic accessories which visually designate environmental factors and other status information and thereby enhance the playing of the game.

20 Claims, 12 Drawing Sheets

(56) References Cited

U.S. PATENT DOCUMENTS 4,850,597 A * 7/1989 Milliken ..... A63F 3/00063 273/254
4,966,372 A * 10/1990 Robison ..... A63F 3/0449 273/252
5,016,888 A 5/1991 Huston et al.
5,088,951 A 2/1992 Majurinen
5,203,847 A 4/1993 Butt
5,924,695 A * 7/1999 Heykoop ..... A63F 9/00 273/440
6,464,507 B1 10/2002 Bailey
7,111,844 B2 * 9/2006 Andrie ..... A63F 3/00697 273/255
7,119,048 B2 * 10/2006 Staadecker ..... B32B 27/08 503/227
7,121,548 B1 10/2006 Heltzinger
7,229,073 B2 6/2007 David
7,287,751 B2 10/2007 Webber, Jr.
7,467,795 B2 * 12/2008 Middleton, Jr. .... A63F 3/00006 273/239
7,731,194 B2 * 6/2010 Ishihara ..... A63F 3/00 273/288
7,862,882 B1 1/2011 White
8,678,874 B2 * 3/2014 Gary ..... G09F 19/08 273/288
2005/0017449 A1 * 1/2005 Belcher ..... A63F 3/00075 273/284
2006/0022404 A1 2/2006 Imai
2006/0131806 A1 * 6/2006 Kenney ..... A63F 3/00697 273/288
2006/0255539 A1 11/2006 Webber
2008/0252006 A1 10/2008 Johnson
2013/0196567 A1 8/2013 Filip
2016/0038839 A1 * 2/2016 Beaudoin ..... A63F 3/00697 463/31
2016/0317907 A1 11/2016 Vandoren

OTHER PUBLICATIONS

"X-Wing Miniatures Magnetic Game Mat Demo 2" http://www.youtube.com/watch?v=HPUVgfQpl5A Web Mar. 17, 2016.
"Yikerz" Magnetic Board Game http://yikerzgame.com/ Web Mar. 17, 2016.
Brennon, "Aftermath Mods Kickstarter Role-Playing Magnetic Boards" http://www.beastsofwar.com/aftermath-mods/aftermath-mods-kickstarter-roleplaying-magnetic-boards/#sthash.QFNk5SVs.dpufhttp://www.beastsofwar.com/aftermath-mods/aftermath-mods-kickstarter-roleplaying-magnetic-boards/ Web Dec. 3, 2013.
"Magetic Dungeon" Swords of Legend, https://swordsoflegend.wordpress.com/2013/03/16/magnetic-dungeon/ Web Mar. 16, 2013.

* cited by examiner

MAGNETIC RECEPTIVE BOARD AND ACCESSORIES FOR TABLETOP GAMING SYSTEM

BACKGROUND OF THE INVENTION

Field of the Invention

This invention relates generally to a magnetic tabletop gaming system and, more particularly, to a system of magnetic and magnetic receptive components used in a tabletop role-playing game, where the components include a magnetic receptive terrain board, a variety of flexible single-sided or double-sided magnets depicting characters or natural/man-made features and structures, magnetic-base stands which can hold one of the magnets in an adjustable position indicating the item's status, and other magnetic accessories which enhance the playing of the game.

Description of the Related Art

Tabletop role-playing games (Dungeons & Dragons, Pathfinder, Warhammer, etc.) have become very popular with many people. These games are typically played on a game board—which could represent anything from a small parcel of land to an entire continent, or an interior of a structure, or any other type of environment—where various character pieces are moved around, interact with other characters and features, and attempt to achieve certain goals.

The vast majority of tabletop role-playing games on the market today define the rules and goals of the game, but do not provide terrains ("game boards") that are both physical and fully customizable for the consumers to use in conjunction with their game. Thus, users are left to their own devices to obtain third-party products depicting terrains and other environments, along with other items which may be used in the games—such as weapons, armor, monsters, tools, structures, furniture, etc.

Once the items described above are obtained or created, and a game is begun, there is always the risk that the table or the game board will accidentally be bumped, and many of the items could be moved from their proper position. This situation understandably causes frustration and delays while the players attempt to restore the game to the condition prior to the board being bumped.

Other situations arise in game play where confusion or delays occur because the status of a character or an environmental condition is not readily known. For example, in some games it is important to know which direction a character is facing, whether it's day or night, what the weather conditions are, and many other factors. Although these factors may have been determined by the players or the game master at an earlier time in the game, there is often no convenient or consistent way to depict the various factors and their status for all players to see.

There is a need for a complete set of components and accessories designed for tabletop role-playing games, where all of the components are magnetic or magnetic receptive and are compatible with each other in size, shape and magnetic properties.

SUMMARY OF THE INVENTION

In accordance with the teachings of the present invention, a system of magnetic and magnetic receptive components used in a tabletop role-playing game is disclosed. The system includes at least one magnetic receptive terrain board depicting an outdoor terrain or other environment, where the terrain board may be two-sided. The system further includes a variety of flexible single-sided or double-sided magnets depicting characters or natural/man-made features and structures which can be attached to the terrain board, and either left in place or moved during game play. Also included are magnetic-base stands which can hold the character/feature magnets in an adjustable position indicating the item's status, and other magnetic accessories which visually designate environmental factors and other status information and thereby enhance the playing of the game.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a tabletop gaming system with magnetic and magnetic receptive components is merely exemplary in nature, and is in no way intended to limit the invention or its applications or uses.

Tabletop role-playing games such as Dungeons and Dragons, Pathfinder, Warhammer, etc. have increased in popularity in recent years, and developed a large following of players. The embodiments of the invention disclosed herein do not create a new "game" with the accompanying rules and goals, but rather describe a system of magnetic-based accessories which consumers can use to enhance the playing of their existing games. The disclosed system provides features and capabilities not previously available to improve the realism of the game being played, and reduce the occurrence of delays due to uncertainty of status or accidental movements.

Role-playing games of the type described above involve player characters moving around a game board, which may generically be referred to as a terrain board. As the characters move around the terrain board (or boards), they encounter a variety of situations and objects which must be dealt with as the characters attempt to reach a destination or achieve a goal. The invention disclosed herein provides many accessories which enhance the playing of these role-playing games—including terrain boards and add-on features compatible with the terrain boards, character pieces, and various status-identifying elements which are operable with the terrain boards and characters.

Figure 1:
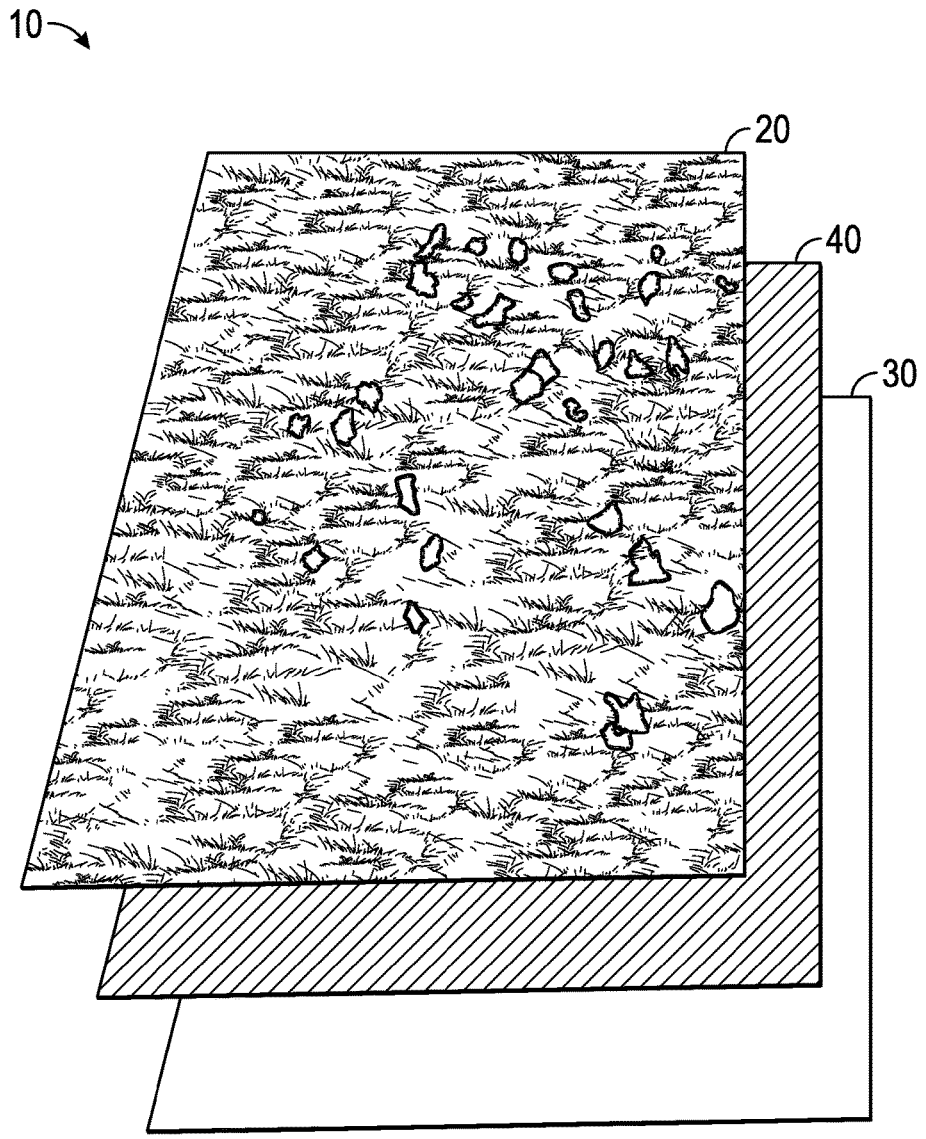
FIG. 1 is an illustration of a magnetic receptive terrain board showing the construction of the terrain board according to one embodiment of the present invention.

FIG. 1 is an illustration of a magnetic receptive terrain board 10 showing the construction of the terrain board 10 according to embodiments of the present invention. The terrain board 10 can be constructed using at least two different types of materials. In either construction, the terrain board 10 has a magnetic receptive characteristic, and has terrain graphics printed on both sides. Throughout this disclosure, a component which is described as "magnetic receptive" is to be understood as something that a magnet will stick to, but is not magnetic in and of itself. As an example, a steel refrigerator door would be considered magnetic receptive.

The graphics printed on the terrain boards 10 may represent many variations of either naturally occurring environments (caverns, grasslands, forests, etc.) or man-made structures (taverns, castles, dungeons, etc.), but will not represent actual geographic locations on Earth. The themes of the terrain boards 10 will vary and can be adapted to fit any theme needed for use with tabletop role-playing games, from fantasy or science fiction to historical military, post-apocalyptic, western, etc.

In one embodiment, represented by FIG. 1, the terrain board 10 includes a top layer 20 made of paper, plastic, or a thin chipboard material and having a scenery or environment graphic printed on the top (outward-facing) surface. For example, the top layer 20 shown in FIG. 1 includes a generic grassland scene. The terrain board 10 also includes a bottom layer 30, which is also made of paper, plastic, or a thin chipboard material and has a scenery or environment graphic printed on the bottom (outward-facing) surface. In most cases, the environment printed on the bottom layer 30 will be different than the environment printed on the top layer 20, so that the terrain board 10 can be used to represent either of the two environments (for example, a grassland or a mountainous region).

Sandwiched between the top layer 20 and the bottom layer 30 is a middle layer 40. The middle layer 40 is made of a thin piece of magnetic receptive metal such as steel. The middle layer 40 need only be thick enough (for example, 1 mm or less) to give the terrain board 10 an appropriate stiffness. Using the construction described above, with thin printed sheets of paper or plastic sandwiched around a sheet of steel, the terrain board 10 will easily exhibit a magnetic receptive characteristic suitable to hold magnetic game pieces in place.

In another embodiment, still represented by FIG. 1, the terrain board 10 includes a top layer 20 made of a magnetic receptive thin-sheet material and having a scenery or environment graphic printed on the top (outward-facing) surface. The magnetic receptive material used for the top layer 20 may be a magnetic receptive vinyl sheet, for example. The terrain board 10 also includes a bottom layer 30, which is also made of the magnetic receptive material and having a scenery or environment graphic printed on the bottom (outward-facing) surface. As mentioned above, the environment graphic printed on the bottom layer 30 will usually be different than the environment graphic printed on the top layer 20.

Sandwiched between the magnetic receptive top layer 20 and the magnetic receptive bottom layer 30 is an optional middle layer 40. The middle layer 40 is made of a stiff chipboard or paperboard of a thickness suitable to give the terrain board 10 an appropriate stiffness. The middle layer 40 may be omitted if the top layer 20 and the bottom layer 30 are comprised of materials which, when laminated together, provide sufficient stiffness to the terrain board 10. Furthermore, it may be desirable in some cases for the terrain board 10 to be flexible enough to roll up for transport or storage. In this case, the middle layer 40 would certainly be omitted, and one or two layers of printed magnetic receptive material would be used.

The terrain board 10 can be used individually, or more than one of the terrain boards 10 can be joined together to create a game environment. The terrain boards 10 can be virtually any shape suitable to a desired gaming environment—including round, or a shape which can be joined with other boards such as rectangular or hexagonal. Also, as described above, the terrain boards can be double-sided (both sides exhibiting magnetic receptive properties, with graphics printed on both sides) or single-sided. In one embodiment, the terrain board 10 is rectangular and has a size of 18 inches by 24 inches.

Figure 2:
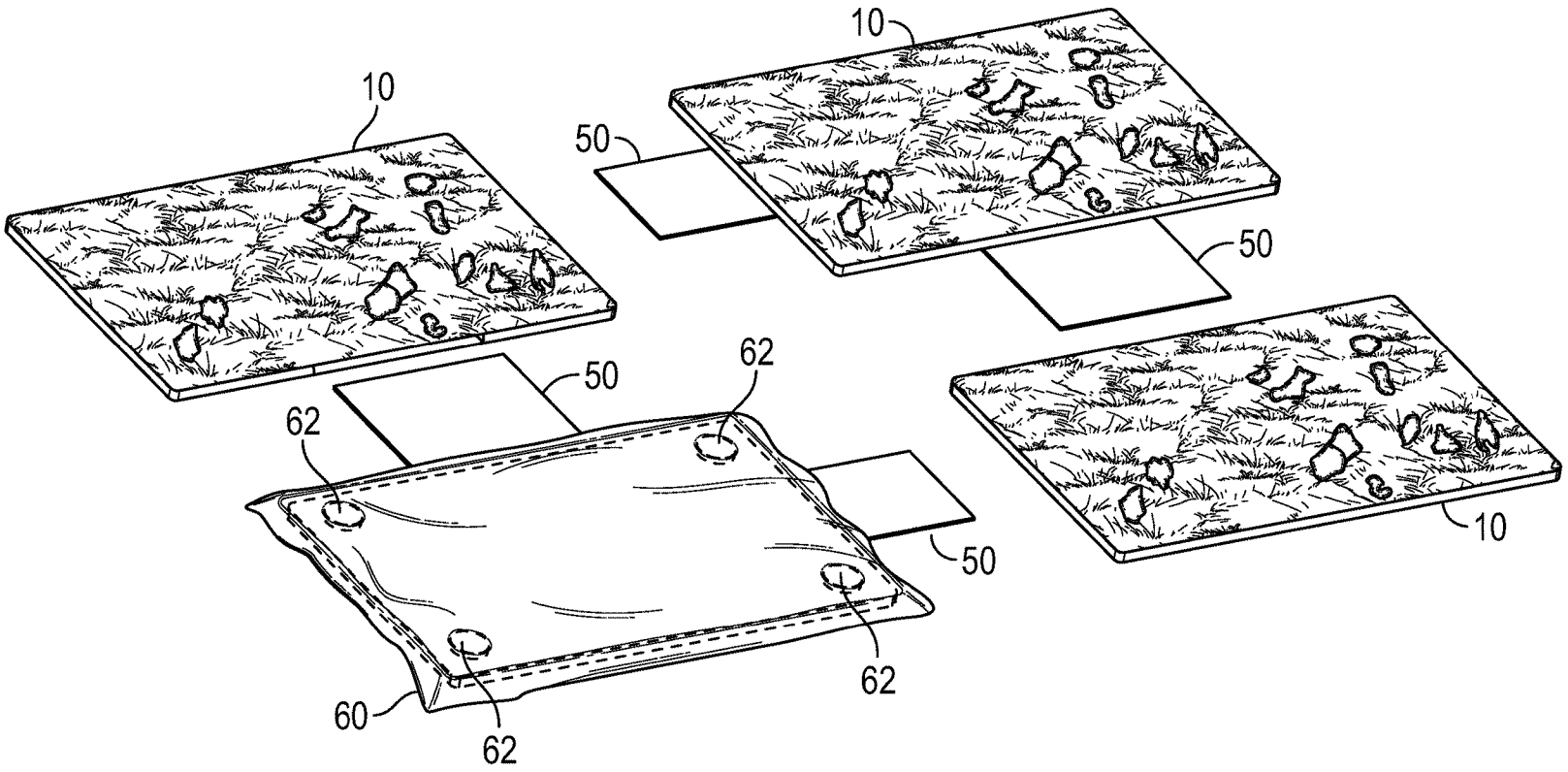
FIG. 2 is an illustration of four of the terrain boards of FIG. 1 arranged in a 2×2 pattern, with magnetic connectors used to connect the terrain boards, and a concealment veil covering one of the boards.

FIG. 2 is an illustration of four of the terrain boards 10 of FIG. 1 arranged in a 2×2 pattern, with magnetic connectors 50 used to connect the terrain boards. The magnetic connectors 50 are thin magnetic sheets which can be placed under the abutting edges of the terrain boards 10 to hold the boards 10 together. In one embodiment, the magnetic connectors 50 are 4"×6" in size. The four terrain boards 10 may all have the same graphic patterns (such as grassland), or more than one graphic pattern may be used. For example, two of the terrain boards 10 may depict a grassland, one of the terrain boards 10 may depict a mountainous region, and one of the terrain boards 10 may depict an interior of a cave or a castle. Any combination of shapes, sizes and scenes is possible—subject only to the players' imagination and the size of the table they are playing on.

A concealment veil 60 is shown covering one of the boards 10 in FIG. 2. The concealment veil 60 includes magnets 62 affixed at least at the four corners of the veil 60. The magnets 62 may be relatively weak, such as rubberized flexible magnets, and glued to the fabric of the veil 60. Alternately, the magnets 62 may be relatively strong, such as iron alloy hard magnets, and sewn into pockets in the fabric of the veil 60. The concealment veil 60 is used to conceal all or portions of any of the terrain boards 10 until such time in the game play when the game master determines that the concealed portion of terrain should be revealed. (The concealment veil 60 should be opaque; the veil 60 is shown as translucent in FIG. 2 only for illustration purposes—to show that there is a terrain board 10 underneath.) The magnets 62 serve to hold the concealment veil 60 in position on the terrain boards 10 until the veil 60 is removed.

Figure 3:
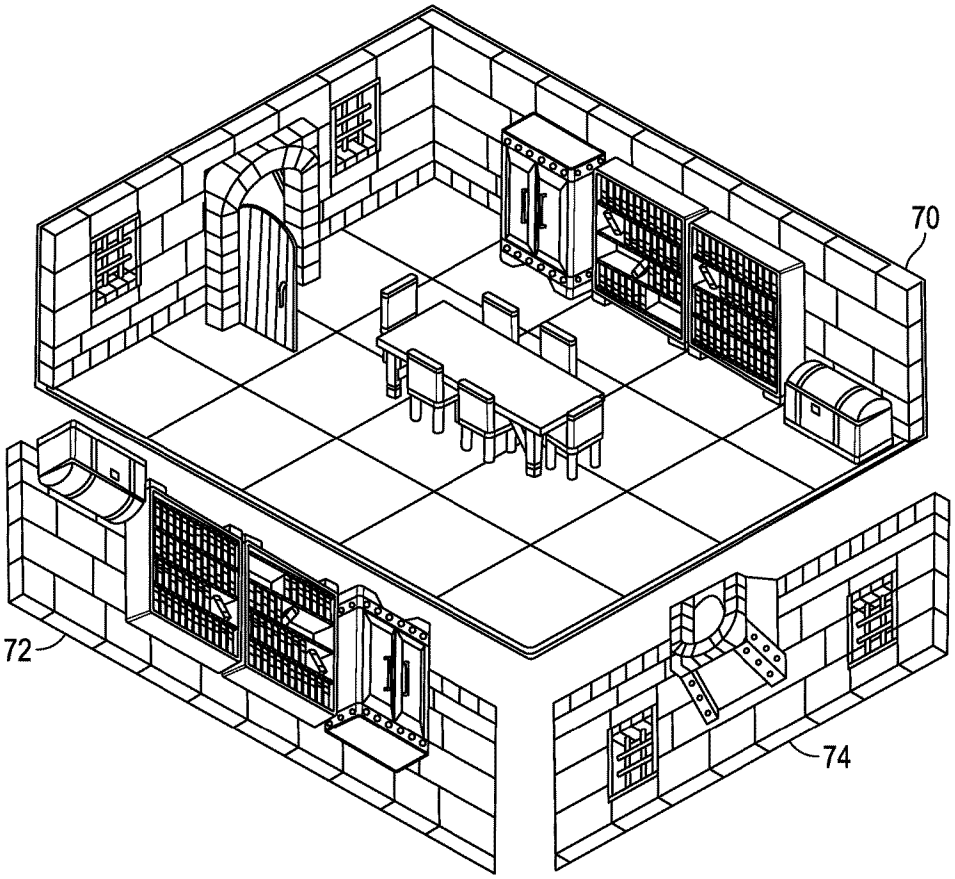
FIG. 3 is an illustration of a magnetic receptive terrain board arrangement depicting a building interior scene, according to another embodiment of the present invention.

FIG. 3 is an illustration of a magnetic receptive terrain board arrangement depicting a building interior scene, according to another embodiment of the present invention. A terrain board 70 depicts one room of an interior of a building, such as a tavern or a castle. The terrain board 70 includes the floor of the room, and the two far-side walls. Two sidewall boards 72/74 depict the two near-side walls of the room. The terrain board 70 and the sidewall boards 72/74 are illustrated in isometric view format (not pure top-down), so that the content of the walls can be shown. Furthermore, the sidewall boards 72/74 show the walls upside down relative to the terrain board 70; this is a preferred isometric view arrangement in tabletop role-playing games, where the sidewall boards 72/74 appear right-side-up when viewed from the opposite side of the terrain board 70.

The terrain board 70, depicting an interior scene, could be used in conjunction with other terrain boards depicting indoor or outdoor scenes, in any suitable combination. The terrain board 70 and the sidewall boards 72/74 may be single-sided or double-sided, as discussed previously. Also, the far-side walls could be shown on separate sidewall boards instead of being incorporated into the terrain board 70. Alternately, the sidewall boards 72/74 (the near-side walls) could be incorporated into the terrain board 70 to comprise a single piece.

The terrain board 70 includes gridlines on the floor of the room. The gridlines may be useful for defining player movement (correlating to a number rolled on a die or dice, for example), and also for positional relationships relative to objects in the room or on the walls. It should be noted that gridlines may also be printed on the terrain board 10 depicting an outdoor terrain, or any terrain board depicting any environment—whether it be indoors, outdoors, underground, underwater, or otherwise.

From the discussion of FIGS. 1-3 above, it can be understood that virtually any game environment can be created using combinations of the terrain boards 10 and 70 and other examples mentioned. This includes outdoor environments, indoor environments, underground, etc. Terrain board arrangements can be created using multiple terrain boards, where the boards can have a defined positional relationship maintained by the connectors 50, or the boards can be placed independently on the tabletop with the rules of the game defining when a character jumps from one terrain board to another.

As discussed above, terrain boards are used to create one or more environments for game play. However, much more detail than a simple grassland scene (for example) is desirable when setting up a game. In order to maintain flexibility in creating gaming environments, the disclosed gaming system includes magnets printed to depict a wide variety of features and characters which may be added to the terrain boards. For consistency in the following discussion, these magnets will be referred to as feature magnets and character magnets. Like the terrain boards 10, the theme of the feature magnets and character magnets can be adapted to fit any theme needed for use with tabletop role-playing games, from fantasy or science fiction to historical military, post-apocalyptic, western, etc.

The feature magnets and character magnets with printed graphics will have varying shapes and sizes, and can be placed on the magnetic receptive terrain boards 10 or atop other feature/character magnets and repositioned at will to adapt to the scenarios encountered in the tabletop role-playing game used by the consumer. The flat, flexible magnets will be stackable on top of each other while maintaining a magnetic connection for the purpose of showing multiple levels of detail. For example, a multi-level house may consist of 4 levels of flexible magnets stacked one on top of another with unique graphics to represent the cellar, first floor, second floor and roof. Some feature magnets and character magnets may be very small relative to the terrain boards 10, while some of the feature magnets may be large enough that player characters can move around within the space defined by the magnet (such as in the house example just mentioned).

Figure 4:
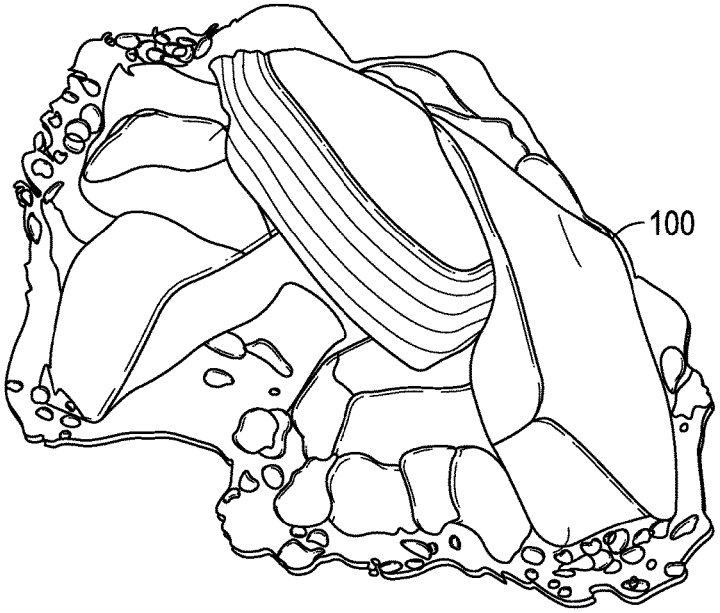
FIG. 4 is an illustration of a feature magnet which can be attached to a terrain board, where the magnet depicts a cavern according to one embodiment of the present invention.

FIG. 4 is an illustration of a feature magnet 100 which can be attached to a terrain board 10, where the magnet 100 depicts a cavern according to one embodiment of the present invention. The feature magnets and character magnets, such as the feature magnet 100, are made of a thin, preferably flexible magnetic material which will magnetically adhere to the terrain boards 10. The feature magnets and character magnets may be single-sided or double-sided, where a double-sided magnet has graphics printed on both sides and exhibits magnetic properties on both sides (either side will stick to the terrain board 10). In the case of double-sided magnets, the two sides may preferably depict two different versions of a certain feature or character—such as a flowing river and a dry riverbed.

The feature magnet 100, a cavern, would typically be applied to one of the terrain boards 10 before a game is started, and would not be moved during game play. Other feature magnets (some examples illustrated in later figures) would also be applied to the terrain board 10 to create a customized environment for the game. For example, the grassland terrain of FIG. 1 could be configured with fixed landscape feature magnets such as caverns, roads, rivers and hills, and other movable features could be added such as weapons and collectibles. Additionally, character magnets in the form of monsters could be placed on the terrain board. Player characters can also be represented by character magnets.

Figure 5:
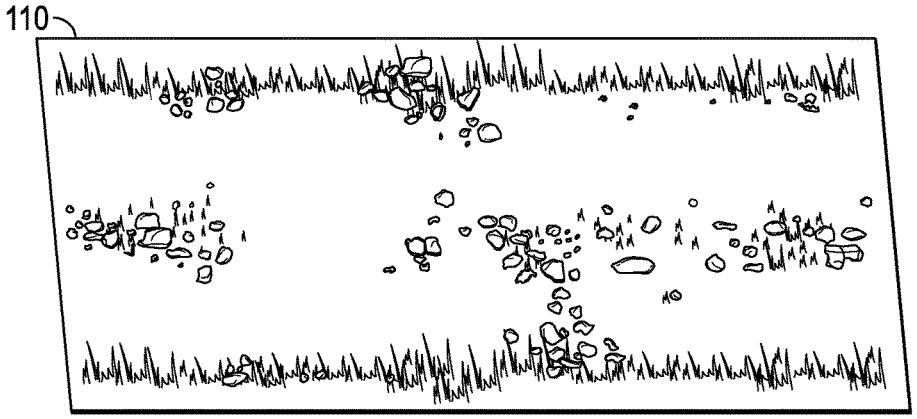
FIG. 5 is an illustration of a feature magnet depicting a dirt road according to another embodiment of the present invention.

FIG. 5 is an illustration of a feature magnet 110 depicting a dirt road according to another embodiment of the present invention. As discussed above, the dirt road of the feature magnet 110 would be applied to the terrain board 10 by the game master before the game is begun, and the dirt road magnet 110 would not be moved during the course of that game. Other feature magnets could depict roads which are curved, tee intersections or four-way intersections, 90° roadway bends, etc.

Figure 6A:
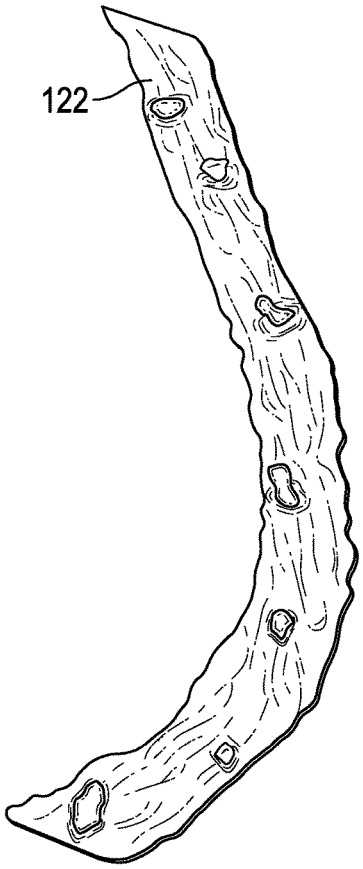
FIGS. 6A/6B are illustrations of a two-sided feature magnet depicting a curved river, with one side showing a flowing river and the other side showing a dry riverbed, according to another embodiment of the present invention.
Figure 6B:
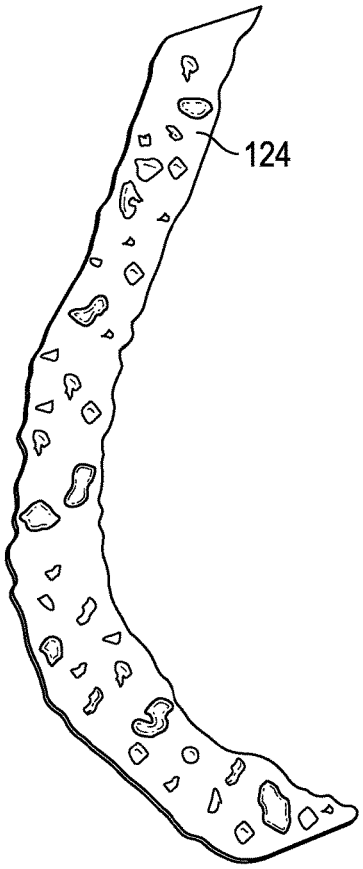

FIGS. 6A/6B are illustrations of a two-sided feature magnet 120 depicting a curved river, with a first side 122 showing a flowing river and a second side 124 showing a dry riverbed, according to another embodiment of the present invention. The two-sided feature magnet 120 could obviously be used as a flowing river in one game and a dry riverbed in another game. The two-sided feature magnet 120 could also be used to represent a feature (the river) which changes characteristics during the course of a single game—where the river changes from a dry riverbed to a flowing river (or vice versa) based on weather conditions or other events during the game. Other feature magnets could depict rivers which are straight, or which include waterfalls, etc.

Figure 7B:
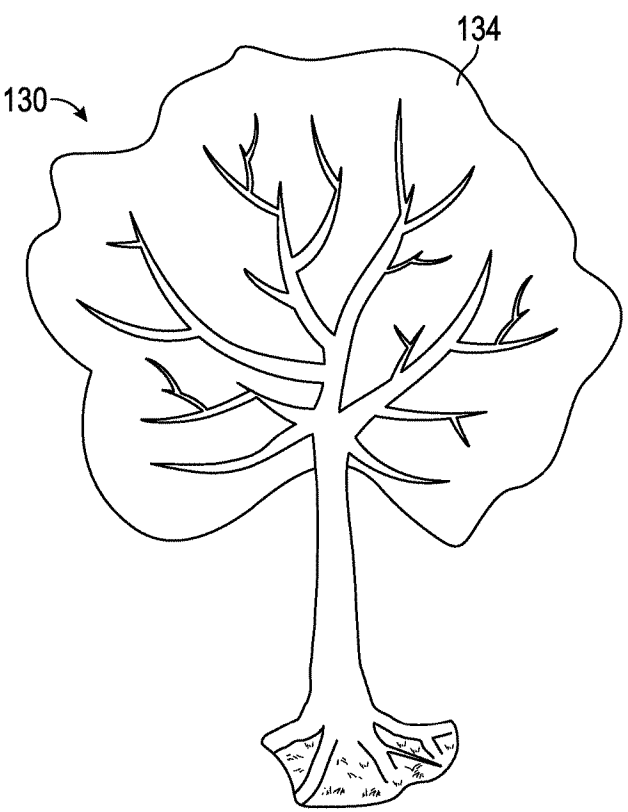
FIGS. 7A/7B are illustrations of a two-sided feature magnet depicting a tree, with one side showing the tree with leaves and the other side showing the tree branches only, according to another embodiment of the present invention.
Figure 7A:
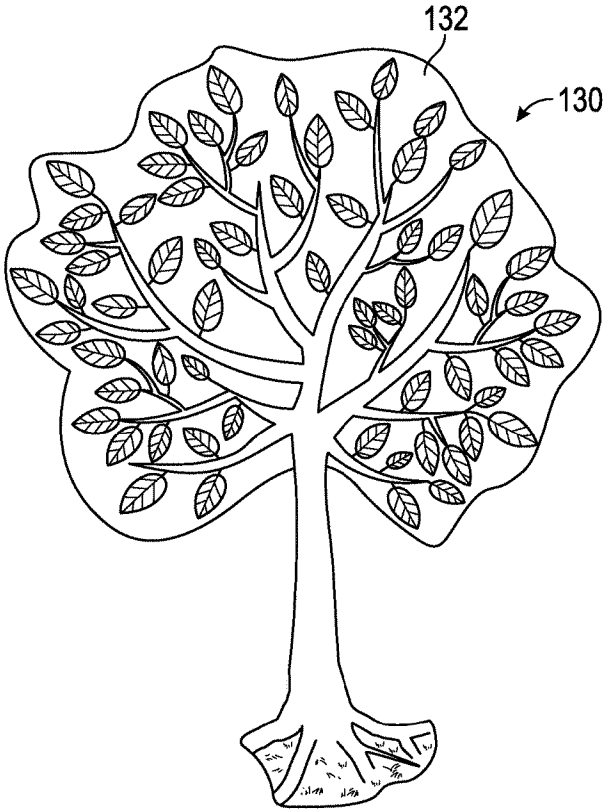

FIGS. 7A/7B are illustrations of a two-sided feature magnet 130 depicting a tree, with a first side 132 showing the tree with leaves and a second side 134 showing the tree branches only, according to another embodiment of the present invention. Unlike the other road and river feature magnets discussed above, the tree feature magnet 130 is shown in a side view (not a top-down view). Thus, although the tree feature magnet 130 could be magnetically attached to the terrain board 10, the magnet 130 could also be placed into a stand to hold it upright, which is discussed further below.

Figure 8:
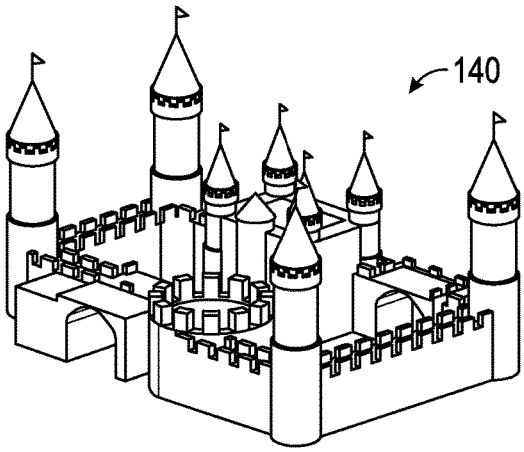
FIG. 8 is an illustration of a feature magnet depicting a castle according to another embodiment of the present invention.

FIG. 8 is an illustration of a feature magnet 140 depicting a castle according to another embodiment of the present invention. A feature such as a castle could be implemented in a variety of ways in a gaming environment. One option is for the castle magnet 140 to be large enough to show interior detail, possibly including multiple levels, so that player characters can move around "in" the castle. Another option is for the castle magnet 140 to be fairly small relative to the terrain board 10, where upon entry to the castle, a character moves to another terrain board such as the terrain board 70 which shows all of the interior detail.

Figure 9:
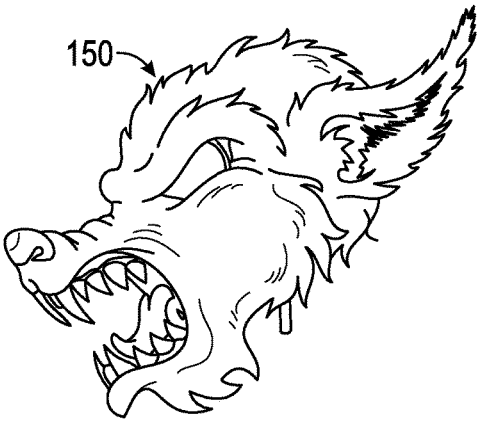
FIG. 9 is an illustration of a character magnet depicting a monster according to another embodiment of the present invention.

FIG. 9 is an illustration of a character magnet 150 depicting a monster according to another embodiment of the present invention. The monster magnet 150 is obviously a character magnet that could be moved around the terrain board 10 during the course of a game. The monster magnet 150 could also be placed underneath ("inside") the cavern magnet 100, whereby the game players would not know what's inside the cavern (a monster, treasure, weapons, etc.) until they "enter" the cavern. In addition to monster-type characters, player characters can also be represented on character magnets similar to the magnet 150. Player character magnets offer the stability of magnetic attachment to the terrain board 10, while still being easily moved around the board as the character travels about.

Figure 10:
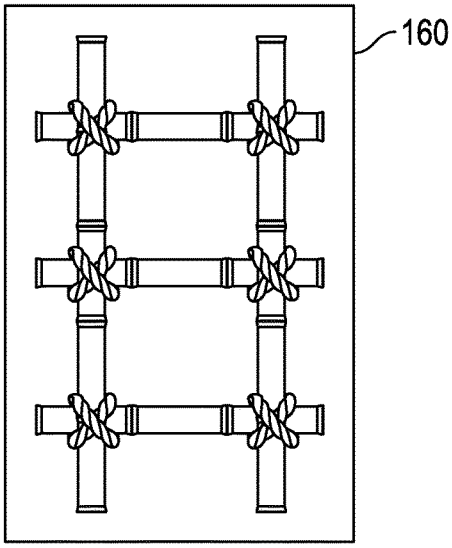
FIG. 10 is an illustration of a feature magnet depicting a ladder according to another embodiment of the present invention.

FIG. 10 is an illustration of a feature magnet 160 depicting a ladder according to another embodiment of the present invention. Similar to the tree discussed above, the ladder on the magnet 160 would benefit from a stand to hold it upright. Other feature magnets could be provided which depict other tools, or weapons, or any other type of item which can be used or encountered in the role-playing game.

Figure 11:
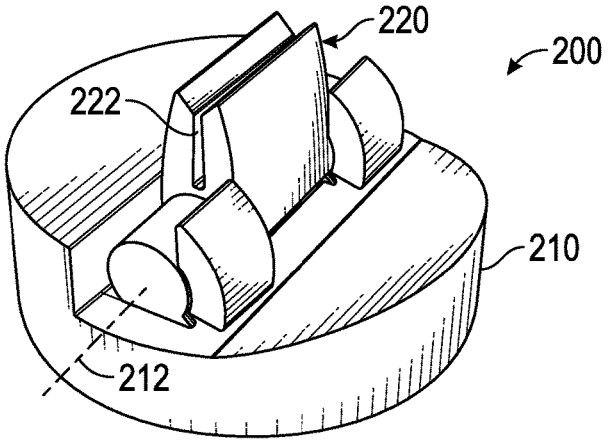
FIG. 11 is an illustration of a pivoting stand with a magnetic base, where the stand is used to hold a feature or character magnet in either a vertical or horizontal position, according to another embodiment of the present invention.

FIG. 11 is an illustration of a pivoting stand 200 used to hold a feature magnet or character magnet, according to an embodiment of the present invention. The stand 200 includes a magnetic base 210 which adheres to the terrain board 10. The stand 200 also includes a body 220 which is adapted to pivot about a horizontal axis 212 with respect to the base 210. The body 220 includes a clip 222 sized to receive one of the feature magnets or character magnets described above. The pivoting motion of the body 220 allows the magnet to be placed in either a vertical or horizontal position.

Figure 12:
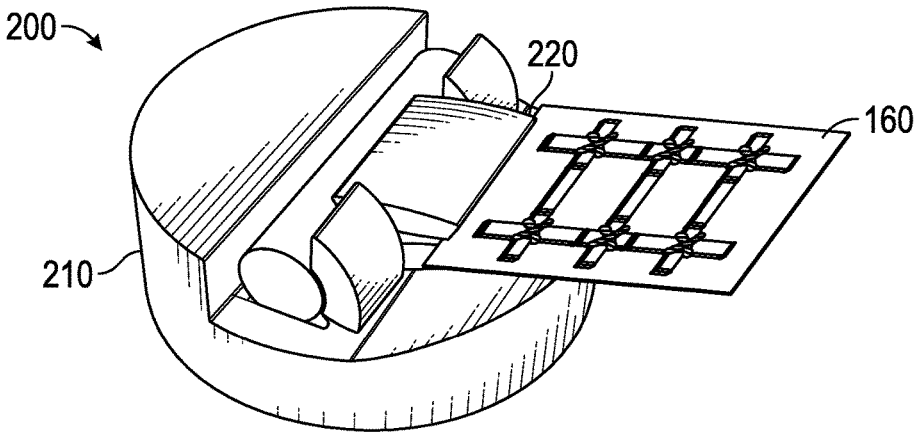
FIG. 12 is an illustration of the pivoting stand of FIG. 11 holding a feature magnet and positioned horizontally.

FIG. 12 is an illustration of the pivoting stand 200 of FIG. 11 holding the feature magnet 160 (the ladder) and positioned horizontally. During game play, the horizontal position of the ladder would typically mean that the ladder is not available for use; in other words, it is either broken, or hidden, or otherwise unavailable. The key feature offered by the pivoting stand 200, not available in traditional tabletop gaming systems, is the ability to adaptively designate the status of a feature or character during game play based on its position (upright, horizontal, or in between). The pivoting stand also offers the benefit of magnetic attachment (of the base 210) to the terrain board 10 for secure location.

Many examples can be envisioned for using the pivot position of the stand 200 to designate the status of an item. If the stand 200 holds a monster, a horizontal position could mean the monster has been defeated. If the stand 200 holds a player character, a horizontal position could mean the character has been injured or spell-bound and must skip one or more turns. If the stand 200 holds a weapon or a tool, such as a catapult or a ladder, a horizontal position could mean the weapon or tool is unusable.

Figure 13:
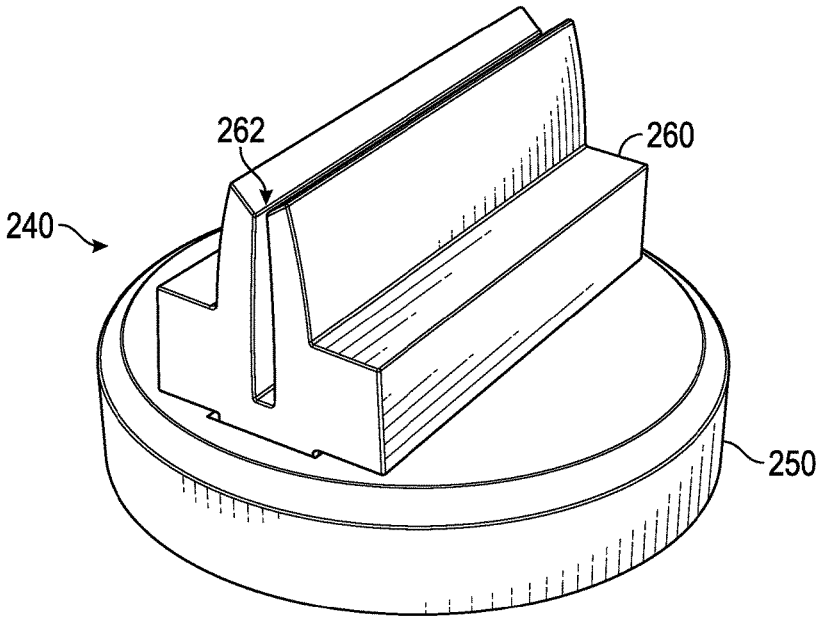
FIG. 13 is an illustration of a stand with a magnetic base, where the stand is used to hold a feature or character magnet, according to an embodiment of the present invention.

FIG. 13 is an illustration of a stand 240 according to another embodiment of the present invention. The stand 240 has a magnetic base 250 and a body 260, where the body 260 includes a clip 262 used to hold a feature magnet or character magnet.

Figure 14:
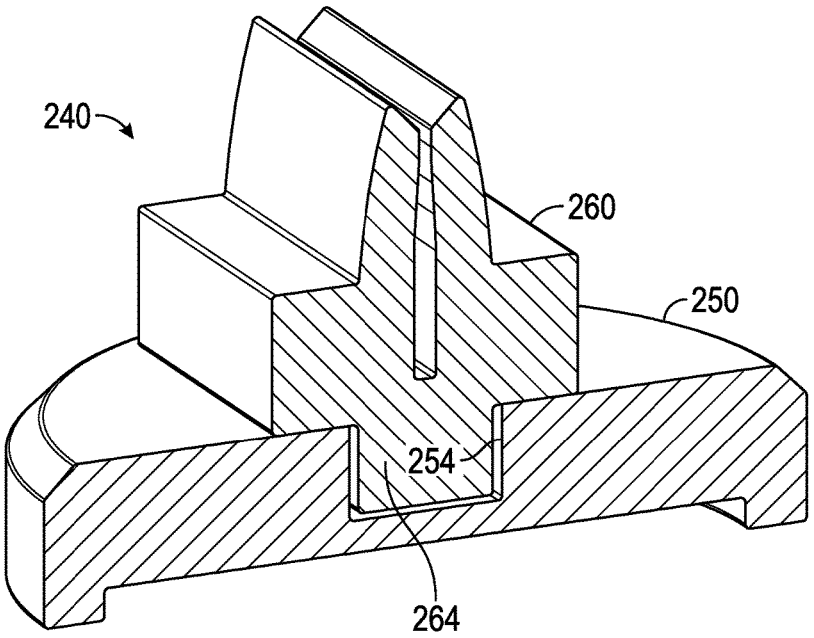
FIG. 14 is a cross-sectional illustration of the stand of FIG. 13 showing how a body portion snap-fits into the magnetic base portion.

FIG. 14 is a cross-sectional illustration of the stand 240 of FIG. 13 showing how the body 260 snap-fits into the magnetic base 250. As shown in FIGS. 13-14, the body 260 is completely detachable from the base 250, and re-attachable via snap fit of a flange 264 on the body 260 into a groove 254 in the base 250. The detachable body feature of the stand 240 can be used in a number of ways in game play. For example, a feature or a character could transform from one form to another form during a game, and the base 250 could be left in place on the terrain board 10 while the body 260 could be exchanged with another holding a different magnet. Or, a character may be transported from a main terrain board to a secondary board, and the base 250 could be left in position on the main board to designate the position of the character when it returns, while a new base 250 could be used to carry the character in the body 260 on the secondary board. Also, the base 250 of the stand 240 can be adapted to hold fully three-dimensional miniature characters ("minis"), thus providing a magnetic retention feature to the minis which they do not traditionally have.

Some items used in a typical tabletop role-playing game are not placed on the game board or terrain board itself, but rather are kept nearby each player around the table. One such item is known as a character sheet, which is used to keep track of various attributes of each player's character.

Figure 15:
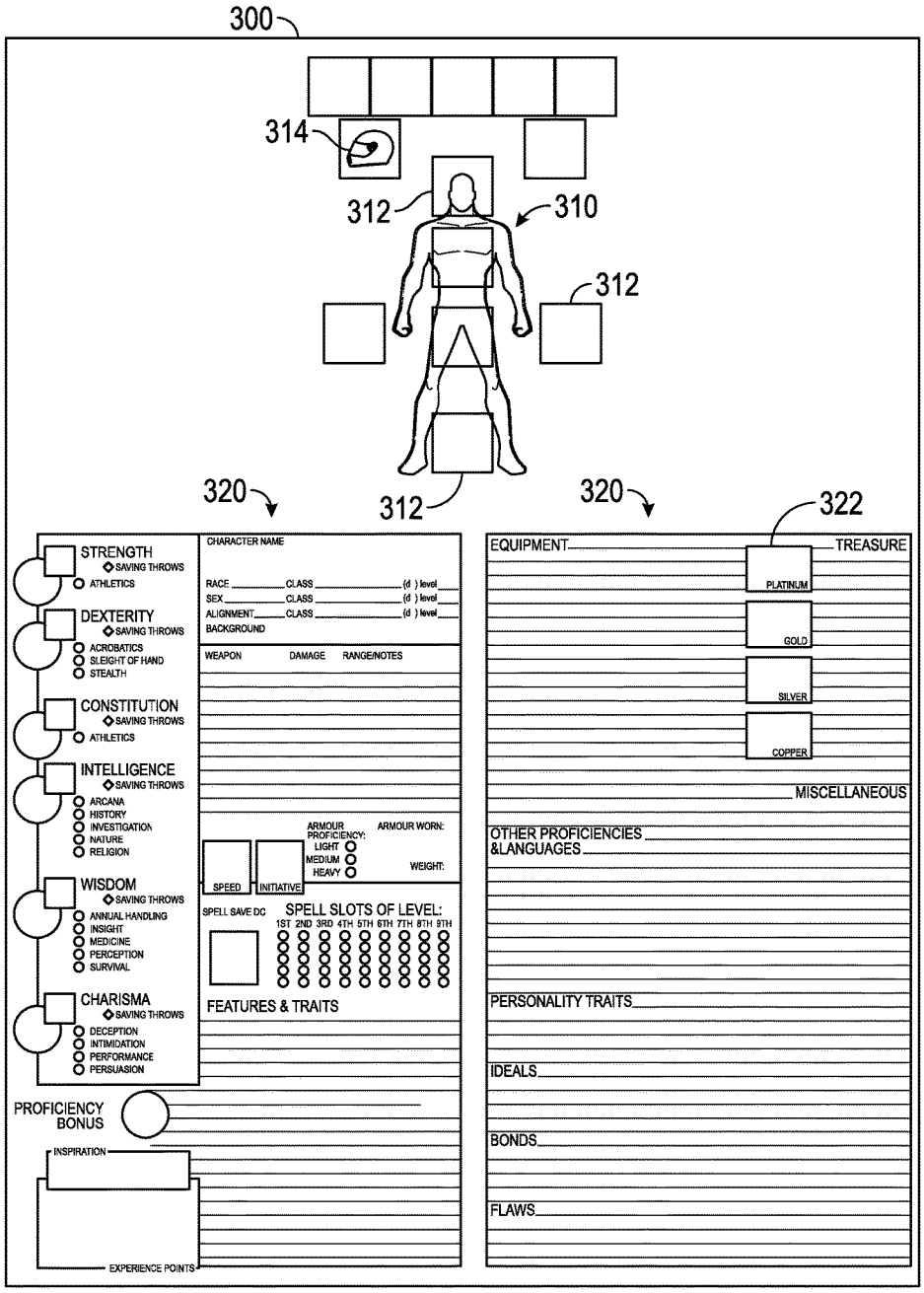
FIG. 15 is an illustration of a magnetic receptive character sheet used to depict status, properties and belongings of a game character, according to an embodiment of the present invention.

FIG. 15 is an illustration of a magnetic receptive character sheet 300 used to depict status, properties and belongings of a game character, according to an embodiment of the present invention. In role-playing games, character sheets are typically a printed paper form that the player fills out to represent the characteristics and abilities of the character they are playing. Traditionally, a printed paper character sheet has to be updated at the end of a gaming session or recreated/reprinted as the character progresses. The character sheet 300 provides the convenience of making changes to the character in real-time via a dry erase marker-compatible surface. The character sheet 300 also provides a magnetic receptive surface with spaces for attachment of small magnets representing items encountered during game play—such as weapons or armor—which may be transferred from the terrain board 10 or from another character to the character sheet 300.

The character sheet 300 is permanently pre-printed with graphics designed to facilitate recording character status and possessions. The graphics shown in FIG. 15 are just one non-limiting embodiment. The graphics may include a character FIG. 310 with boxes 312 designed to accept small magnetic tokens 314 which represent items worn or possessed by the character. The items represented by the tokens 314 and placed in the boxes 312 include things like armor and helmet worn by the character, weapons carried by the character, and other objects possessed by the character (e.g., rope, food and water, etc.). The visual representation of the character's equipment using the magnetic tokens 314 provides an enhancement to the game-playing experience, and allows objects to be physically transferred from one character to another (via the tokens 314) or from the game board to a character.

Traditional paper character sheets do not offer the ability to have equipped gear represented as graphics, but rather merely written descriptions of the gear that the player has equipped. With the magnetic receptive character sheet 300, players will be able to physically remove and replace their character's gear as the story progresses. For example, if a character trips and drops his sword, the player can then remove the weapon magnet indicating that his character is no longer in possession of his weapon. Alternatively, if the player finds better armor than what he currently has equipped, he can simply swap out the existing magnetic token 314 on his character sheet 300 for a different token 314 representing the new, better armor.

The pre-printed graphics on the character sheet 300 also include a section 320 where written notes are made using a dry-erase marker. The section 320 typically includes attributes and characteristics of the character—ranging from Race and Sex to characteristics of personality, intelligence and physical prowess. These attributes can be defined and arranged in any suitable manner—including combinations of check-boxes, tabular data and free-form written descriptions. The section 320 can also include boxes 322—similar to the boxes 312 discussed above—where magnetic token 314 can also be applied. In this case, the tokens 314 could represent coins, incremental levels of strength or intelligence, or any other object or parameter that is relevant to the character.

The character sheet 300 may be made of any suitable magnetic receptive material—such as the magnetic receptive vinyl sheet discussed above in one embodiment of the terrain board 10, or a piece of sheet steel covered with plastic which is printed on one side with the graphics shown in FIG. 15.

The character sheet 300 provides an efficient and satisfying means of recording and displaying information and attributes about each character in a role-playing game. However, there are other attributes and properties which may apply to the entire gaming environment—not just to an individual character—which need a different means of display and update during a game.

Figure 16:
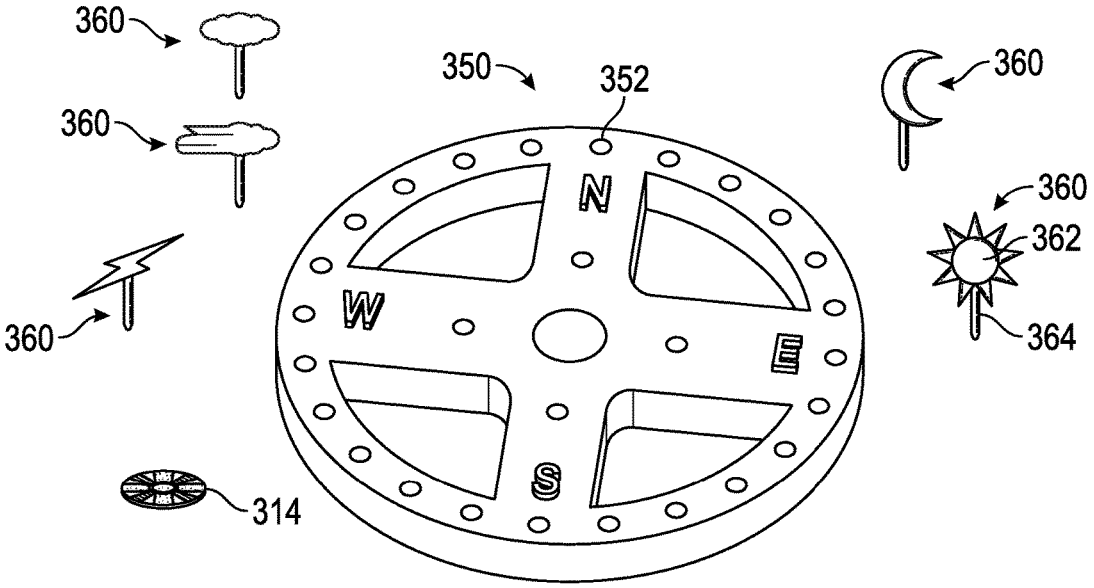
FIG. 16 is an illustration of a compass piece including features for depicting environmental factors in the game, including directional orientation, weather, sun position, time, and others—according to an embodiment of the present invention.

FIG. 16 is an illustration of a compass piece 350 including features for depicting environmental factors in the game, including directional orientation, weather, sun and moon position, time, and others—according to an embodiment of the present invention. The compass piece 350 is used to record and display attributes and properties which apply to the entire gaming environment—not just to an individual character. The compass piece 350 may also be used to display the status of each individual character as it relates to environmental data such as compass direction, as will be discussed below.

One of the most common interruptions of tabletop gaming is stopping the action to clarify basic information such as which direction a character is facing, the time of day, the current weather conditions, the position of the sun in relation to a character, etc. With the compass piece 350, players will now have all of that information available to them in real time. The compass piece 350 will not only show the typical North/South/East/West directions, but will allow for additional tokens to be attached to represent all of the information available about the current environmental conditions.

The compass piece 350 would typically be placed on the terrain board in an orientation indicating compass directions, and this orientation would not change during game play. The N/S/E/W directions may be printed or embossed on the top surface of the compass piece 350. The compass piece 350 is preferably both magnetic on the bottom to adhere to the terrain board and magnetic receptive on top to receive small magnetic tokens like the tokens 314 discussed above.

In addition to receiving the magnetic tokens 314, a preferred embodiment of the compass piece 350 includes vertical holes 352 in the top surface of the compass piece 350 for receiving small pin tokens 360. The pin tokens 360 have a body 362 designed to visually depict a certain parameter, and a pin 364 protruding from the bottom of the body 362, where the pin 364 is designed to fit in the vertical holes 352 in the compass piece 350. The pin tokens 360 are designed to indicate parameters and conditions such as sun position, moon phase and position, and weather conditions such as temperature, cloudiness, wind and precipitation.

The holes 352 are also designed to receive tokens 360 indicating time of day and time of year. The compass piece 350 may include, near each of the holes 352, markings for time of day and time of year. In this regard, it is preferable to include either 12 or 24 of the holes 352 around the circumference of the compass piece 350 so that, for example, the position of one of the tokens 360 could indicate that the time is 2:00 pm and another of the tokens 360 could indicate that the month is June. It may also be advantageous to include two concentric rings of the holes 352, where one ring (for example, the outer ring) is used exclusively for time tokens (hour of day, and month of year), and the other ring (the inner ring) is used for weather, solar/lunar and character tokens. Many different such designs are possible.

Each character in the game may also have one of the tokens 360 placed in one of the holes 352, where the character tokens may be placed in holes 352 along spokes 354 of the compass piece 350, rather than holes 352 around the outer circumference.

Given the features and elements of the compass piece 350 described above, all of the environmental factors affecting the game and the characters are managed, recorded and visible for all players. The game master or other designated person continuously updates the various phases of the sun and moon, weather conditions, etc. on the compass piece 350. The following scenario involving both sun position and character orientation describes how this information becomes important. If a character is an archer, the position of the sun can greatly affect the accuracy of the arrows fired at the enemy. If the compass piece 350 shows that the sun is at the archer's back, he/she may very well choose to attack knowing that there is a much greater chance of a successful attack than if the sun is shining directly in his/her eyes. Having all such relevant environmental information consistently displayed on the compass piece 350 is a major enhancement to role-playing gaming.

The design of the compass piece 350 shown in FIG. 16—which is basically flat—is just one non-limiting embodiment. The compass piece 350 may be made highly three-dimensional, or stylized in any way deemed suitable for game play. For example, a sundial-like arch may be added over the compass piece 350, defining the position of the sun as it passes overhead from east to west. Regardless of specific style or design, the features described above for receiving and repositioning tokens indicative of sun, moon and weather conditions, player parameters, time, etc.—are preferable in any design.

Figure 17:
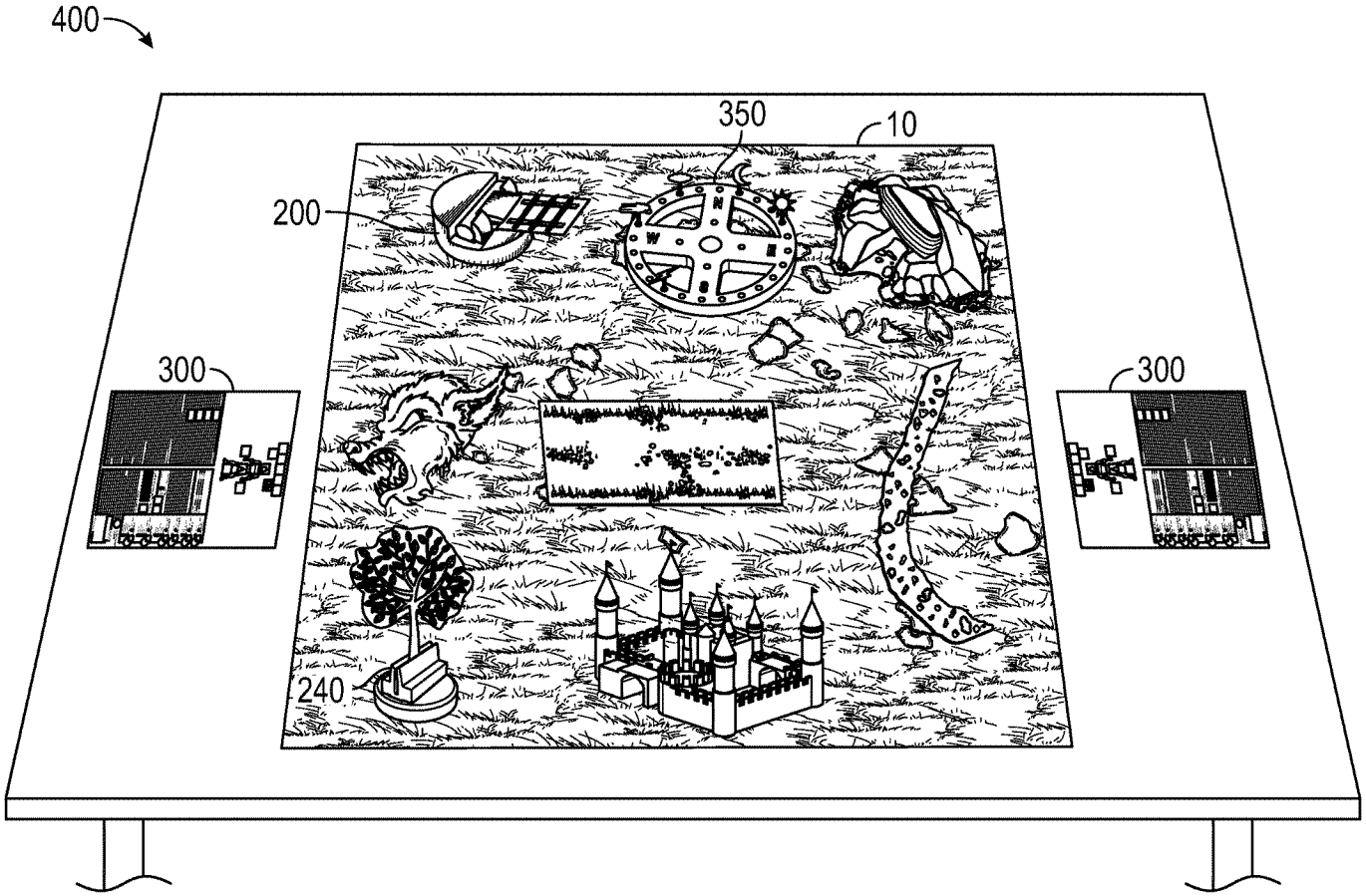
FIG. 17 is an illustration of a complete tabletop gaming system according to embodiments of the present invention.

FIG. 17 is an illustration of a complete tabletop gaming system 400 according to embodiments of the present invention. The system 400 includes one or more of the terrain boards 10/70, shown here as one large version of the terrain board 10. As discussed above, more than one of the terrain boards 10 could be used, connected by the connectors 50, where the terrain boards 10 may all represent the same type of terrain or they may be different. Interior terrain boards 70 may also be used in conjunction with or in place of the terrain boards 10.

The terrain board 10 of FIG. 17 is configured with several of the feature and character magnets shown in FIGS. 4-10 and discussed previously. For example, the terrain board 10 has been supplemented with a road feature magnet 110, a river feature magnet 120, and a cavern feature magnet 100. A ladder feature magnet 160 and a tree feature magnet 130 are also shown in the stands 200 and 240, respectively, on the terrain board 10. Using the pivoting stand 200, the status of a feature or character can be changed based on whether the feature or character magnet is upright or horizontal. The concealment veil 60 is not shown in FIG. 17—but could be used to conceal a portion of the terrain board 10 as discussed previously.

Two of the character sheets 300 are shown in FIG. 17, one each at the player's seating positions on the left and right of the table. More of the character sheets 300 would be used if needed—one for each player. One of the compass pieces 350 is also shown, affixed to the terrain board 10 and displaying some of the parameters described in detail above.

The sizes of the items on the terrain board 10 of FIG. 17 are not necessarily to scale; many items have been drawn larger to improve visibility and to illustrate the complete gaming system concept—including the terrain board 10, an array of many features and characters added to customize the environment, stands, the compass piece, the character sheets, etc. Of course, many other feature magnets and character magnets could be added to the gaming environment on the terrain board 10, and their combinations and arrangements can be varied indefinitely to create any gaming environment imaginable.

It should be understood that the invention described above, directed to a tabletop gaming system with magnetic and magnetic receptive components, also encompasses a method for playing a tabletop role-playing game—including providing the terrain board(s) 10, placing the feature magnets and character magnets 100-160 on the terrain board(s), placing feature magnets and character magnets in the stands 200/240 and reconfiguring the stands to designate item status, providing the character sheets 300 with magnetic tokens 314, and providing the compass piece 350 with magnetic tokens 314 and pin tokens 360.

Furthermore, the magnetic properties of the components may be reversed from what is specified for the embodiments described above. That is, instead of the terrain board 10 being magnetic receptive as described above, the terrain board 10 could be magnetic, and the features and characters would in this case be magnetic receptive instead of magnetic. Other changes would also be made to keep the entire system compatible; the compass piece and the reconfigurable stands would be magnetic receptive, the character sheet would be magnetic like the terrain board, and the tokens would be magnetic receptive.

The tabletop gaming system 400 provides features and capabilities not previously available in tabletop gaming—including full magnetic attachment and compatibility of all boards, features and characters, a completely customizable gaming environment using the feature magnets and character magnets, repositionable stands which designate the status of the inserted feature or character magnet, and magnetic character sheets and compass piece for displaying character and environment properties. These features and capabilities result in a richer and more realistic gaming environment, and one where all pieces are magnetically secured to prevent accidental movement, all of which are desirable to tabletop role-playing gaming enthusiasts.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A tabletop gaming system for a role-playing game, said system comprising:

a magnetic receptive terrain board, said terrain board including a top layer having a scenery or environment graphic printed on a top outward-facing surface, a bottom layer having a scenery or environment graphic printed on a bottom outward-facing surface, and a middle layer positioned between and adhesively affixed to the top layer and the bottom layer, where either the middle layer or both the top and bottom layers are made of a magnetic receptive material;

a plurality of feature magnets each depicting a terrain feature to be added to the terrain board, where the feature magnets are made of a flexible magnetic material suitable to magnetically attach to the terrain board or to other feature magnets;

a plurality of character magnets each depicting a character to be moved about the terrain board, where the character magnets are made of a flexible magnetic material suitable to magnetically attach to the terrain board or to feature magnets;

one or more reconfigurable stand, said stand having a body portion with a clip adapted to receive one of the feature magnets or the character magnets, said stand further having a base portion with a magnet installed in a bottom of the base portion to magnetically attach to the terrain board or to one of the feature magnets, where the body portion including the feature magnet or the character magnet in the clip has a position which is reconfigurable relative to the base portion, and the position indicates a status of the feature magnet or the character magnet in the clip;

a plurality of magnetic tokens and pin tokens each representing an environmental factor or a character factor affecting the game;

a plurality of magnetic receptive character sheets with pre-printed text and graphics and a dry erase marker-compatible surface, where status properties of a character are representable on the character sheets via written notation with a dry-erase marker and via placement of one or more of the magnetic tokens; and a compass piece made of a two-sided magnetic material suitable to magnetically attach a bottom surface of the compass piece to the terrain board and attach one or more of the magnetic tokens to a top surface, said compass piece having compass directions printed or embossed on the top surface, where the top surface of the compass piece includes a plurality of vertical holes adapted to receive one or more of the pin tokens.

2. The gaming system according to claim 1 wherein the top layer and the bottom layer of the terrain board are made of paper, plastic or chipboard, and the middle layer is made of steel.

3. The gaming system according to claim 1 wherein the scenery or environment graphic printed on the top layer of the terrain board is different than the scenery or environment graphic printed on the bottom layer of the terrain board.

4. The gaming system according to claim 1 wherein the feature magnets and the character magnets each have two opposing sides and are magnetic on both sides and have graphics printed on both sides, and where the graphics on opposite sides of one of the feature magnets or the character magnets represent the same physical item in two different conditions.

5. The gaming system according to claim 1 wherein the feature magnets depict terrain features including caverns, rivers, roads, mountains, castles, taverns, bridges, weapons and tools.

6. The gaming system according to claim 1 wherein the feature magnets and the character magnets are magnetically stackable on top of one another on the terrain board.

7. The gaming system according to claim 1 wherein the reconfigurable stand includes a horizontal pivot axis coupling the body portion to the base portion, where the body portion positioned vertically indicates the feature magnet or the character magnet in the clip is in a normal condition, and the body portion positioned horizontally indicates the feature magnet or the character magnet in the clip is in a defeated or unusable condition.

8. The gaming system according to claim 1 wherein the body portion of the reconfigurable stand is fully detachable from the base portion, where a flange on a bottom of the body portion snap-fits into a groove in a top of the base portion.

9. The gaming system according to claim 1 wherein the magnetic tokens used on the character sheets are designed to represent armor, weapons, coins and other treasure.

10. The gaming system according to claim 1 wherein the magnetic tokens and the pin tokens used on the compass piece are designed to represent the sun, the moon in various phases, wind, weather conditions, time of day, time of year, player characters and monster characters.

11. The gaming system according to claim 1 wherein the vertical holes in the compass piece are arranged in a circular pattern around a circumference of the compass piece.

12. The gaming system according to claim 11 wherein the vertical holes around the circumference of the compass piece include exactly 12 or 24 holes and include markings for time of day and time of year.

13. The gaming system according to claim 11 further comprising additional vertical holes in spokes connecting the circumference to an inner hub of the compass piece.

14. The gaming system according to claim 1 further comprising one or more additional magnetic receptive terrain boards and one or more magnetic connector sheets for connecting adjacent terrain boards to each other, where the scenery or environment graphic printed on the terrain boards may all be the same or may be different.

15. A tabletop gaming system for a role-playing game, said system comprising:

a plurality of magnetic receptive terrain boards, said terrain boards each including a top layer made of a magnetic receptive material and having a scenery or environment graphic printed on a top outward-facing surface, a bottom layer made of a magnetic receptive material and having a scenery or environment graphic printed on a bottom outward-facing surface, and a middle layer made of a chipboard or paperboard, where the middle layer is positioned between and adhesively affixed to the top layer and the bottom layer;

a plurality of magnetic connector sheets for connecting adjacent terrain boards to each other, said magnetic connector sheets comprising a flexible magnetic material;

a plurality of feature magnets each having two opposing sides and each depicting a terrain feature to be added to the terrain board, where the feature magnets are made of a flexible magnetic material suitable to magnetically attach to the terrain board or to other feature magnets, where each of the feature magnets has either single-sided or double-sided printing and magnetism, and the printing on opposite sides of any double-sided feature magnet represents the same physical item in two different conditions;

a plurality of character magnets each depicting a character to be moved about the terrain board, where the character magnets are made of a flexible magnetic material suitable to magnetically attach to the terrain board or to feature magnets, and where the character magnets may have single-sided or double-sided printing and magnetism;

a plurality of reconfigurable stands, said stands each having a body portion with a clip adapted to receive one of the feature magnets or the character magnets, a base portion with a magnet installed in a bottom of the base portion to magnetically attach to the terrain board or to one of the feature magnets, and a horizontal pivot axis coupling the body portion to the base portion, where the body portion positioned vertically indicates the feature magnet or the character magnet in the clip is in a normal condition, and the body portion positioned horizontally indicates the feature magnet or the character magnet in the clip is in a defeated or unusable condition;

a plurality of magnetic tokens and pin tokens each representing an environmental factor or a character factor affecting the game;

a plurality of magnetic receptive character sheets with pre-printed text and graphics and a dry erase marker-compatible surface, where status properties of a character are representable on the character sheets via written notation with a dry-erase marker and via placement of one or more of the magnetic tokens; and a compass piece made of a two-sided magnetic material suitable to magnetically attach a bottom surface of the compass piece to the terrain board and attach one or more of the magnetic tokens to a top surface, said compass piece having compass directions printed or embossed on the top surface, where the top surface of the compass piece includes a plurality of vertical holes adapted to receive one or more of the pin tokens.

16. The gaming system according to claim 15 wherein the scenery or environment graphic printed on the top layer of each of the terrain boards is different than the scenery or environment graphic printed on the bottom layer.

17. The gaming system according to claim 15 wherein the feature magnets depict terrain features including caverns, rivers, roads, mountains, castles, taverns, bridges, weapons and tools.

18. The gaming system according to claim 15 wherein the vertical holes in the compass piece include a set of exactly 12 or 24 holes arranged in a circular pattern around a circumference of the compass piece and having markings indicating time of day and time of year, and a set of additional vertical holes in spokes connecting the circumference to an inner hub of the compass piece.

19. The gaming system according to claim 15 wherein the magnetic tokens and the pin tokens used on the compass piece are designed to represent the sun, the moon in various phases, wind, weather conditions, time of day, time of year, player characters and monster characters.

20. A method for playing a tabletop role-playing game, said method comprising:

providing a magnetic receptive terrain board, said terrain board including a top layer having a scenery or environment graphic printed on a top outward-facing surface, a bottom layer having a scenery or environment graphic printed on a bottom outward-facing surface, and a middle layer positioned between and adhesively affixed to the top layer and the bottom layer, where either the middle layer or both the top and bottom layers are made of a magnetic receptive material;

placing a plurality of feature magnets on the terrain board, where the feature magnets each depict a terrain feature and are made of a flexible magnetic material suitable to magnetically attach to the terrain board or to other feature magnets;

placing a plurality of character magnets in initial positions on the terrain board, where the character magnets each depict a character and are made of a flexible magnetic material suitable to magnetically attach to the terrain board or to feature magnets;

placing a plurality of the feature magnets and the character magnets each in a reconfigurable stand, said stand having a body portion with a clip adapted to receive one of the feature magnets or the character magnets, said stand further having a base portion with a magnet installed in a bottom of the base portion to magnetically attach to the terrain board or to one of the feature magnets, where the body portion including the feature magnet or the character magnet in the clip has a position which is reconfigurable relative to the base portion, and the position indicates a status of the feature magnet or the character magnet in the clip;

providing a plurality of magnetic tokens and pin tokens each representing an environmental factor or a character factor affecting the game;

providing a plurality of magnetic receptive character sheets with pre-printed text and graphics and a dry erase marker-compatible surface, where status properties of a character are representable on the character sheets via written notation with a dry-erase marker and via placement of one or more of the magnetic tokens;

placing a compass piece made of a two-sided magnetic material in a prescribed directional orientation on the terrain board, said compass piece having compass directions printed or embossed on a top surface, where the top surface of the compass piece includes a surface suitable for attachment of one or more of the magnetic tokens and a plurality of vertical holes adapted to receive one or more of the pin tokens; and playing the game, including moving the character magnets on the terrain board, moving and reconfiguring the stands containing the feature magnets and the character magnets, updating the status properties on the character sheets, and updating placement of the magnetic tokens and the pin tokens on the compass piece.

* * * * *